United States Patent [19]

Balsells

[11] Patent Number: 4,655,945

[45] Date of Patent: Apr. 7, 1987

[54] BEARING SEAL AND METHOD OF MANUFACTURE

[75] Inventor: Peter J. Balsells, 17592 Sherbrook Dr., Tustin, Calif. 92680

[73] Assignees: Peter J. Balsells; Joan C. Balsells, both of Tustin, Calif.

[21] Appl. No.: 823,254

[22] Filed: Jan. 28, 1986

[51] Int. Cl.[4] ..... C10M 147/02

[52] U.S. Cl. ..... 252/124; 252/12; 252/12.2; 252/12.6

[58] Field of Search ..... 252/12, 12.2, 12.4, 252/12.6; 524/546

[56] References Cited

U.S. PATENT DOCUMENTS 3,655,611 4/1972 Mueller et al. ..... 252/12

3,808,130 4/1974 Schiefer et al. ..... 252/12.4

3,962,373 6/1976 Petrucelli ..... 524/546

*Primary Examiner*—Jacqueline V. Howard

*Attorney, Agent, or Firm*—Walter A. Hackler

[57] ABSTRACT

The present invention includes a method for the manufacture of a bearing seal which includes providing a polymer and/or a filler coated with a polymer and thereafter heating the coated filler to bond the copolymer to the filler. Following cooling of the coated filler, it is pulverized and added to granular polytetrafluoroethylene. This admixture is then mixed to obtain a uniform blend and thereafter shaped by compacting and heating into a preselected form. Fillers suitable for the present invention may be carbon, metal, glass, carbide, disulfide, polymeric, polyester fluoride and ceramic fibers.

20 Claims, 2 Drawing Figures

BEARING SEAL AND METHOD OF MANUFACTURE

The present invention is directed to bearing seals and a method of manufacture thereof. More particularly, the present invention is directed to a bearing seal with a high degree of chemical compatibility, high inertness, low friction, excellent self-release properties and low abrasion to mating parts.

Proper seals are items of major importance throughout industry and the successful operation of many devices is critically dependent upon the seals incorporated therein.

Seals are called upon to function in a wide variety of environments. Varying conditions of pressure, temperature, and resistance to acidic or caustic materials, are many of the factors involved in the proper selection of seal materials.

In order to function successfully, a bearing seal must be of proper design and be composed of a suitable material or combination of materials. In many instances, the method of producing the seal from a variety of materials is significant in achieving a bearing seal having desired characteristics for a particular use.

Polytetrafluoroethylene (PTFE) has been widely used in bearings, seals, and the like, and as a starter material in the fabrication of bearings and seals.

PTFE is a fluorine-based polymer which can be processed by sintering, compression molding, ram extrusion and other processes not melting the PTFE, as it is not melt-processable.

Because of its white color, PTFE has many applications in medical and clean room devices.

It is well known that PTFE, when formed by sintering, or the like, has a structure which is approximately 60% crystaline and 40% amorphous with well defined parallel crystalline bands. The exact percentage of crystalline and amorphous portions of the PTFE is dependent upon the sintering temperature and the rate of cooling following sintering thereof.

It is this structure that imparts the deficiencies of PTFE in bearing seals.

For example, under low and elevated temperatures, the parallel crystalline lamellar bands slide readily across the amorphous matrixes therebetween which causes poor creep and wear resistance of PTFE.

To overcome the failings of PTFE, a number of additives, or fillers, have been used therewith to improve the creep and wear resistant properties of PTFE.

For example, glass fibers are incorporated into PFTE because the combination thereof is resistant to creep. However, the combination carries with it the disadvantage of being very abrasive which may significantly affect the life of the device into which it is incorporated.

Carbon powder has been used as a filler and although it reduces extrusion, creep and wear, it also results in an abrasive composition.

Graphite powder when used as a filler in sufficient quantities results in a composition having a lower coefficient of friction and higher conductivity than polytetrafluoroethylene itself, however, graphite powder filled polytetrafluoroethylene tends to have poor wear resistance.

Polymer fillers have been used with PTFE in applications where low abrasion is required.

Molydisulfide has been used in those applications where the parts are to be used in vacuum, or in contact with the inert gases, or where a certain degree of extrusion resistance is desirable.

Ceramic reinforcing fibers, or whiskers, have been used to provide creep and extrusion resistance. An example of this type of reinforcement fiber is described in plastics compounding July/August, 1985 issue, at page 20, in an article entitled, "New Submicron Ceramic Reinforcing Fiber."

While many investigators have been attempting to improve the characteristics of PTFE in bearing seal applications, other investigators have been developing entirely new compounds with improved characteristics.

For example, a copolymer of hexafluoroisobutylene and vinylidene fluoride has been developed and disclosed in U.S. Pat. Nos. 3,720,655 and 3,706,723. This composition, as well as the fabrication and molding of the copolymer, is fully disclosed in the referenced patents, hence, no further detailed description of the properties and capabilities thereof will be set forth herein.

However, all of the properties of this copolymer and the methods of formulation thereof which have been published (for example U.S. Pat. No. 3,720,655 and 3,706,723) are to be considered as part of the present invention and are incorporated herein by reference thereto. The copolymer of hexafluoroisobutylene and vinylidene chloride (hereinafter referred to as copolymer) by itself has many improved properties over PTFE. These improved properties include greater hardness, strength, rigidity, shear modulus, and high temperature resistance.

Furthermore, this copolymer is melt-processable by conventional thermoplastic methods. This is to be contrasted with PTFE which is not melt-processable. A combination of PTFE and the copolymer is described in U.S. Pat. No. 3,962,373, wherein finely divided, low-molecular weight PTFE articles are combined with the copolymer.

The finely divided PTFE is prepared by subjecting unsintered PTFE obtained by polymerization of PTFE in aqueous suspension, or dispersion, to beta or gamma radiation, of intensity between 5 to 15 megarad to reduce the molecular weight and thereby degrading it into a waxy product. The PTFE is mechanically subdivided into a fine powder of about 15 microns maximum particle size.

The powdered PTFE is blended with the copolymer in a conventional manner at room temperature to produce a melt-processable composition, which is thereafter fabricated by conventional extrusion molding and other melt-processable techniques.

It is apparent from the elaborate preparation of the PTFE and the copolymer that coatings and articles molded from this combination are very expensive.

The present invention overcomes the deficiencies of PTFE when used separately in forming bearing seals and the like, which have unexpected resistance to wear. The present invention incorporates the hereinabove-described copolymer with PTFE, having particle sizes of between 25–150 microns, or larger. This distinguishes the present invention from prior art blends of copolymer and PTFE in which a maximum or 15 micron PTFE article size is taught, and has a significant cost advantage in the manufacture of bearing seals.

Bearing seals made in accordance with the present invention are further distinguished over the prior art in that the resulting blend is not melt-processable, but rather formable into bearing seals by sintering, or the like.

A further feature of the present invention is the utilization of a filler with the PTFE and copolymer and a specific method of combining the filler, copolymer and PTFE in order to produce a bearing seal, and material, with significantly improved abrasion and heat resistance.

Furthermore, bearing seals made in accordance with the present invention have increased wear resistance, display a significant reduction of coefficient friction, great stability at high temperatures, chemical compatibility and with proper selection of filler can be formed into bearing seals having a white color, which is compatible with the food processing medical and pharmaceutical industries.

While having significant advantage in applications such as bearing seals, material manufactured in accordance with the method of the present invention may find many other uses. It may be used in any application in which PTFE has been found to be useful. These applications include coating, films, sheet stock, rods, tubes and plates which are resistant to abrasion at high temperatures, and/or have a low coefficient of friction, and are inert in acidic and caustic environments. All of these applications are well known in the art.

SUMMARY OF THE INVENTION

A method in accordance with the present invention for the manufacture of a bearing seal includes the steps of adding a particulate copolymer of hexafluoroisobutylene and vinylidene fluoride to particulate polytetrafluoroethylene and mixing the mixture to a uniform blend. This blend is then compacted and heated into a preselected shape.

In addition, the present invention includes coating a filler with a copolymer of hexafluoroisobutylene and vinylidene fluoride and thereafter heating the coated filler to bond the copolymer to the filler.

Following cooling of the coated filler, it is pulverized and added to polytetrafluoroethylene.

The admixture may then be mixed to obtain a uniform blend thereof and thereafter shaped by compacting and heating into a preselected shape.

More particularly, the filler may be coated with a solid copolymer of hexafluoroisobutylene and vinylidene fluoride, having a particle size greater than about 10 microns.

It should be noted that the copolymer is melt-processable, with a melting temperature of approximately 330° C. (620° F.). Hence, the coated filler may be heated to the melting point of the copolymer to facilitate coating and bonding of the copolymer to the filler.

Specifically, the copolymer may include about 10 to about 52 mol percent, 3,3,3-trifluoro-2-trifluoromethyl propene and correspondingly about 90 to about 48 percent 1,1-difluoromethylene.

During the pulverization of the cooled coated fillers, the particle size thereof is reduced to between about 10 to 150 microns. This pulverized cooled coated filler is thereafter added to the polytetrafluoroethylene which may have a particle size of approximately 25 microns to 90 microns.

Upon mixing thereof, the blend of filler coated with the polymer and polytetrafluoroethylene may include from about 0.1 to about 25 percent by weight of copolymer and about 1 percent to about 25 percent by weight filler, the remaining portion of the blend being polytetrafluoroethylene.

A number of fillers may be utilized in the bearing seal, depending upon the final application thereof. Fillers suitable for the present invention may be selected from a group consisting essentially of carbons, metals, glasses, carbides, disulfides, sulfides, mineral fibers, polymerics, polyesters, fluorides and ceramic fibers.

Solid materials suitable for bearing seals similarly may be produced according to the method of the present invention. In this instance, reinforcement fibers are coated with a melt-processable copolymer of hexafluoroisobutylene and vinylidene fluoride. Thereafter, the coated fibers are heated to bond the melt-processable copolymer to the fibers, cooled and pulverized.

The pulverized fibers coated with the copolymer are added to polytetrafluoroethylene and thereafter mixed into uniform blend. Solid products are thereafter formed by sintering the blend at appropriate temperatures.

Alternatively, copolymers of hexafluoroisobutylene and vinylidene fluoride may be added with the pulverized coated filler to the polytetrafluoroethylene. In this manner, the total amount of copolymer in the resulting blend may be varied over a wider range.

According to the present invention, the cooled coated fibers may be pulverized to a particle size of between about 10 microns to about 150 microns and the particulate polytetrafluoroethylene added to the blend as a particulate size of about 25 microns.

In this method, the fibers are coated with solid polymer of hexafluoroisobutylene and vinylidene fluoride having a particle size greater than about 10 microns.

It should be appreciated that the method of the present invention enables the production of a non-melt-processable material suitable for bearing seals without complicated coagulation steps, or the use of radiation equipment to achieve minute particle size.

The present invention also includes the resulting non-melt-processable material which is suitable for bearing seals. This material includes a fiber coated with a copolymer of hexafluoroisobutylene and vinylidene fluoride with the coated fiber being dispersed in polytetrafluoroethylene. It is also believed that the copolymer separately added is able to disperse within the blend to a greater extent than the copolymer coated filler and enter the amorphous area of the polytetrafluoroethylene between the crystalline bands thereof.

In this material, the copolymer comprises about 0.1 to about 25 percent by weight non-melt-processable material and the fiber comprises about 0.1 to about 25 percent by weight of the non-melt-processable material, with the polytetrafluoroethylene comprising the remainder of the material.

The fibers may include a fiber selected from the group consisting of essentially glass, carbon, graphite, carbide, mineral, polymeric and ceramic fibers, with the fiber having length of about 10 microns to about 150 microns.

Specifically, the copolymer comprises about 10 to about 52 percent 3,3,3-trifluoro-2-trifluoromethyl propene and correspondingly about 90 to about 48 percent 1,1-difluoroethylene.

It should be appreciated that while the copolymer may be used by itself in many applications and is receptive to fillers to enhance its properties, heretofore there has been no use of the copolymer in combination with PTFE which includes an admixture of PTFE having a particle size greater than 15 microns. As hereinbefore noted in U.S. Pat. No. 3,772,249, efforts heretofore have involved complicated steps of production of lubricant grades of PTFE and the use of 10 micron size particles which are expensively obtained.

Further, the material and the method of the present invention for producing the material results in a non-melt-processable solid. Unlike prior art mixtures, the material and the method of the present invention are directed to a sinterable material for use in forming bearing seals and the like.

It has been discovered that such a sinterable composition can be formed by adding a copolymer of hexafluoroisobutylene and vinylidene fluoride in particulate form to particulate polytetrafluoroethylene when the copolymer has a partial size greater than about 50 microns and its polytetrafluoroethylene has a partial size greater than about 25 microns.

BRIEF DESCRIPTION OF THE DRAWINGS

The advantages and features of the present invention will appear from the following description, considered in conjunction with the accompanying drawings, in which.

DETAILED DESCRIPTION

Figure 1:
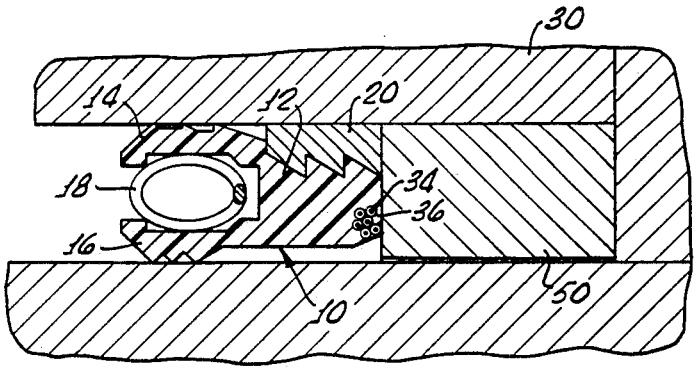
FIG. 1 is a cross-section of a bearing seal manufactured in accordance with the present invention generally showing a seal body, a canted coiled spring and a metal support band.
Figure 2:
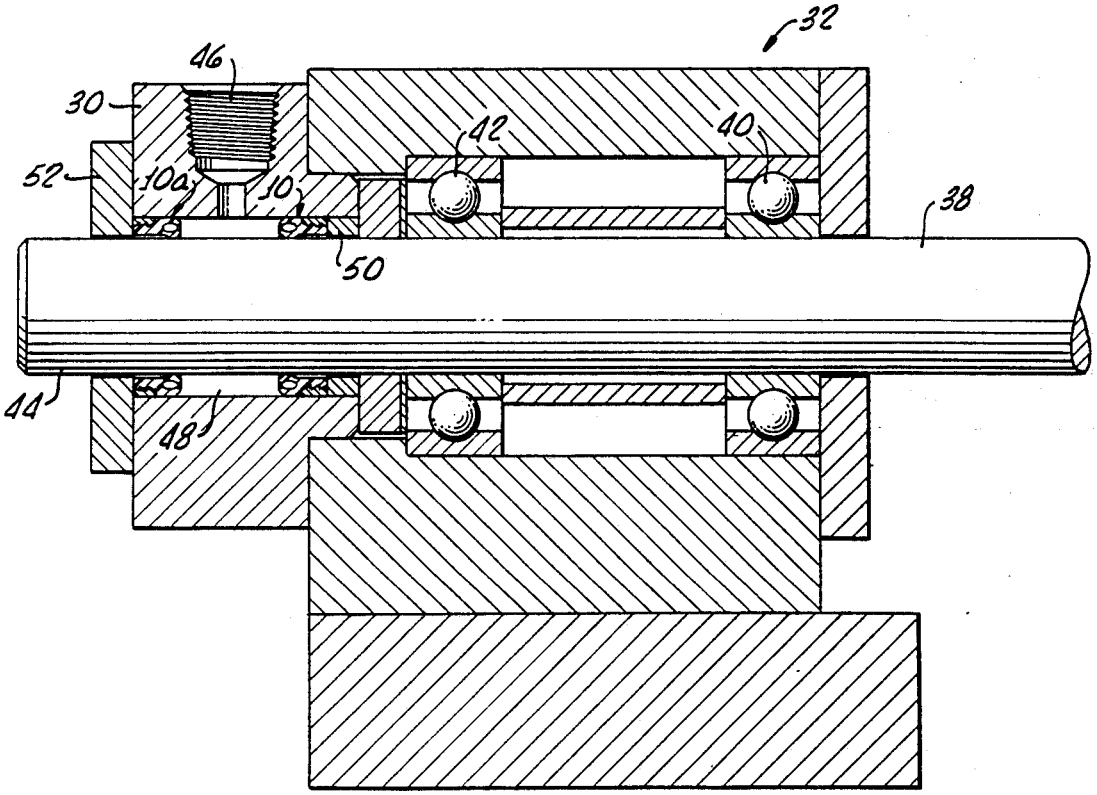
FIG. 2 is a cross-section of test apparatus incorporating seals made in accordance with the present invention for the purpose of seal evaluation and performance as hereinafter reported.

Turning now to FIGS. 1 and 2, there is shown a seal 10 in accordance with the present invention which includes a body portion 12 having a pair of lips 14, 16 surrounding a canted coil spring 18.

The body 12 and the integral lips 14, 16 were made in accordance with the method of the present invention and include a non-melt-processable material, or composition, including an admixture of copolymer and PTFE. Preferably, the material includes a fiber coated with a polymer of hexafluoroisobutylene and vinylidene fluoride with the coated fiber being dispersed in polytetrafluoroethylene.

In general, the copolymer of hexafluoroisobutylene amounts to about 0.1 to about 25 percent by weight of the non-processable material and the fiber is present in an amount from about 0.1 to about 25 percent by weight of the non-processable material.

The spring 18 may be made from any suitable material such as stainless steel and a similar metal band 20 may be provided to enable the seal to be press-fitted into a housing 30 for use with a device (not shown) simulated by test apparatus 32 shown in FIG. 2. As will be hereinafter described in greater detail, the test apparatus 32 is useful in comparing bearing seals made in accordance with the present invention and with seals made with conventional bearing seal materials.

It should be appreciated that the present invention is described herein in connection with a specific seal embodiment, however, the seal and method of the present invention is useful in the manufacture of seals having various forms depending upon the specific application for which the seal is intended.

In addition, as shown in FIG. 1, the fibers 34 with copolymer coating 36 thereon are not drawn to scale, but greatly enlarged to facilitate an understanding of the present invention.

The present invention utilizes the copolymer of hexafluoroisobutylene and vinylidene fluoride as described in U.S. Pat. No. 3,706,723, 3,720,655, 3,893,987 and 3,903,045. Details as to the starting materials reactions and procedures necessary to produce these copolymers is adequately described in the hereinabove-referenced U.S. Patents and incorporated herewith by specific reference thereto. Hence, no further details are provided herein for the sake of brevity.

Generally, the copolymer utilized in the present invention is a highly crystalline copolymer of hexafluoroisobutylene and vinylidene fluoride having superior properties regarding hardness rigidity, abrasion resistance than polytetrafluoroethylene (PTFE).

The copolymer is melt-processable and has a melting point of approximately 331° C. (620° F.) which is approximately the same temperature of the gel point of PTFE, which is not melt-processable.

As hereinabove-mentioned, the copolymer is crystalline in structure, with a spacing of from 4–5 angstroms. Many fillers have been used with the copolymer and the copolymer has been used in combination with PTFE as hereinbefore-discussed.

On the other hand, PTFE is a fluorine-based polymer which may be processed by sintering and generally consists of a series of parallel crystalline lamellar bands with amorphous matrixes in between.

Studies have shown that the crystalline bands are approximately 100 to 300 angstroms apart and under load, and/or conditions of elevated temperatures, the bands move relative to one another, thereby exhibiting poor creep and wear characteristics.

It is also well known that the creep and wear resistance of PTFE is enhanced by the addition of fillers to the PTFE and its is believed that these fillers tend to reduce the relative movement of the layers by interlocking them, resulting in a filled PTFE with higher extrusion resistance, higher creep resistance, lower tensile strength, lower modulus and lower elongation.

It has been found in accordance with the present invention that a substantial improvement in the mechanical properties of PTFE compositions may be achieved when blending, molding and processing the copolymer of hexafluoroisobutylene and vinylidene fluoride with PTFE.

Further, a bearing seal, or material, when made in accordance with the method of the present invention, results in unexpectedly superior properties, as will be hereinafter documented.

In general, the method of the present invention entails the coating of the filler with the copolymer of hexafluoroisobutylene and vinylidene fluoride. The coating may be done by simply mixing the solid particles of the copolymer with the solid filler material, which may be of a number of types.

In fact, the filler, which may be in powder, fiber or whisker form, utilized in the method and material of the present invention, may be any material presently suitable for use in filling PTFE such as, for example, glass fibers, carbon powder, graphite powder, etc.

Where high conductivity is desired, carbon fillers may be used. Any well known polymer fillers may be used in those applications where low abrasion is required to mating parts.

Similarly, molydisulfide may be preferred in those applications where the parts contacted by the seal are to be used in a vacuum or in contact with inert gases.

Recently, ceramic whiskers have been utilized as hereinbefore-discussed. All of these fibers are suitable for use in the present invention, with a particular filler being selected for the specific application as is well known in the art.

One importance of the present invention is the method of combining the filler, or fiber, with the copolymer and the PTFE and the resultant material having an unexpectedly superior abrasion characteristics.

The copolymer may have a particle size of greater than 10 micron, hence, complex chemical procedures are not necessary in order to implement the present invention. In fact, because the particle size of the copolymer is relatively large, 10 microns, no exotic means are necessary to achieve micron or angstrom size particles. However, it is believed that the additions of the copolymer to the blend separately from the coating on the fibers can enter the PTFE structure between the crystalline bands because of its relatively small particle size.

After the fibers have been mixed and coated by the copolymer, the combination may be heated in order to melt, or fuse, the copolymer to the fiber at a temperature from 322° C. to 400° C.

It should be appreciated that a preferable temperature is one that melts the copolymer or causes it to bond with the filler without melting of the filler itself.

Following the heating step, standard pulverizing equipment (not shown) may be utilized to reduce the particle size of the coated fiber down to between 10 microns and about 150 microns. Thereafter, the pulverized coated filler is mixed with polytetrafluoroethylene solid, having a particle size of about 25 microns.

It should again be appreciated that the particle size of the particulate PTFE is not extraordinarily small, and therefore extreme procedures necessary to reduce it to a smaller particle size, as has been done in the prior art, are not necessary. Thus, the method in accordance with the present invention involves very conventional steps which can be performed easily without expensive processing equipment.

Further distinguishing the present invention from the prior art are the properties and usefulness of the present composition. For example, in U.S. Pat. No. 3,962,373, the composition is useful for coating purposes and for such purpose, a very small particle size is needed.

In order to obtain this small particle size, which is between 2 and 15 microns, it is necessary to irradiate the PTFE and, in doing so, break up the long chain of the PTFE, hence changing the PTFE from a high molecular weight to a low molecular weight.

When this is done, the low molecular weight PTFE will never bond to itself or to another PTFE material, and therefore, can never be molded in rods, tubes, plates and the like, and could not be made into seals and bearings of the present invention. In other words, the two materials are distinct and different, and even though the properties are generally the same, the mechanical properties are not. For example, if low molecular weight PTFE were compacted in the same manner and in the same processing as that that is done in regular PTFE, there would be no bonding; therefore, no tensile strength and no elongation. For these reasons, the low molecular weight, as used in the prior art and the high molecular weights used in the present invention cannot be equated.

Following the blending of the PTFE and the coated fiber portions thereof, the blend is compacted and heated into a preselected shape, such as a rod, tube or plate, and thereafter fabricated into a bearing seal 10, 10*a*, as shown in FIGS. 1 and 2, having a body 12 and a pair of sealing lips 14, 16 disposed on opposite sides of a canted coil spring 18. Additionally, a metal band 20 may be formed into the seal 10 in order to facilitate its inserting into a housing 30 for testing of the seal as hereinafter described.

To evaluate the performance of seals made in accordance with the present invention, a test fixture 32, shown across section in FIG. 2, was utilized.

It should be appreciated that the bearing seal 12 and test fixture are not drawn to scale. Additionally, in order to represent the composition of the present invention fiber, or filler, particles 34 with a copolymer coating 36 are shown greatly out of scale in FIG. 1.

As hereinbefore discussed, it is believed that the copolymer may enter the PTFE structure between its crystalline bands and an exact drawing of this is not presented herein.

A shaft 38 mounted between bearings 40, 42 includes an end portion 44 extending through the housing 30.

A pair of seals 10, 10*a* were press fitted into the housing 30 to form a seal between the housing 30 and the shaft end portions 44. A hydraulic access 46 was provided between the two seals 10, 10*a* in order to pressurize the volume 48 therebetween with SAE 30 oil at a pressure of approximately 3000 psi.

The seals used for evaluation were made from various compositions, as identified in the hereinafter presented examples, and were sized with a 0.625 inch inside diameter and 0.812 outside housing diameter. The sealing lips 14, 16 were biased by the canted coiled spring 18 so that there was initial sealing at no pressure.

Seal 10, located closer to the bearing 42, was provided with a bronze support ring 50, with a minimum clearance between the shaft and the bronze ring 50 to reduce the possibility of extrusion of the seals.

On the other hand, the seal 10A located away from the bearing 42 was supported by a ring 52 with a radial clearance of approximately 0.003 inches between the ring 52 and the shaft 38, in order to accelerate the failure rate of the seal 10A being tested, through extrusion past the ring 52, wear or leakage. In other words, the increased space between the ring 52 and the shaft 38 provided less support for the seal 10A and, hence, accelerated the extrusion, or failure thereof.

The shaft 38 was made from carbonized steel with a surface hardness of Rockwell C-60 with an 8 RMS.

Tests were run on 17 examples and the results are summarized in Table 1.

In Examples 1 through 6, PTFE was blended with a variety of fillers, for example, graphite, Ryton V-1 (available from Phillips Petroleum Corporation, Bartersville, Okla.), Ekonol (available from Carborundum Company, Niagara Falls, N.Y.), glass fibers, carbon fibers and amorphous carbon. The carbon blend utilized had a particle size of about 1 micron whereas the glass fiber had a particle size of about 600 microns. Hence, it can be appreciated that the present invention encompasses a wide range of filler or fiber particle sizes.

These seals were made by blending PTFE having a particle size of about 25 microns, with the filler having a particle size of approximately varying from 1 micron to 600 microns in amounts indicated in Table 1, and thereafter free-sintering the material into bearing bodies 12.

It is apparent from a reading of the test results that the Example 1–4 seals failed in less than 10 minutes due to extrusion of the seal through the opening between the ring 48 and the shaft 38 (see FIG. 2) when pressurized to 3000 psi, and subjected to a rotating shaft at 3600 RPM.

It should be appreciated that although the tests were performed at elevated temperatures and pressures to accelerate the failure thereof, it is expected that operation of the seals at lower temperatures and pressures will correspond to the results herein reported.

Also unexpected is the significant increase in seal life as should by comparing Example 1–4 seals with Example 12–14 seals. Example 12, 13, 14 seals employed the copolymer and Example 1–4 seals employed graphite Ryton V-1 Ekonol and glass fibers, respectively.

This shows the use of copolymer without fillers provide for a seal having about 5 to about 10 times the life compared to typical filler materials such as Ryton V-1 or Ekonol.

In Examples 5 and 6, the extrusion was not as severe, however, failure is due to heavy leakage of oil past the seal.

Similarly, in Examples 7 and 8 where PTFE was filled with glass fiber, molydisulfide and Rulon A, (available from Dixon Corporation, Bristol, R.I.), respectively, heavy extrusion and failure of the seal occurred in 10 minutes or less.

Examples 9, 10, 11 resulted in seals that held up longer, however, still failed in less than one hour.

An unexpected and unpredictable seal life was demonstrated in Examples 15, 16 and 17 when a coated carbon filler, or fiber, is incorporated in accordance with the present invention. In Example 15, a small amount of irradiated PTFE having a particle size of less than about 6 microns (Polymist 5A, available from Allied Chemical, Morristown, N.J.), was also added to the PTFE with the coated carbon fiber.

It is evident from Table 1, the extended longevity of the seal and the test procedure, failure did not occur for between 20 to 44 hours in Examples 15, 16 and 17. This is to be compared with a matter of minutes for seals made in a conventional manner by blending PTFE with fillers.

Hence, it is apparent that the method of the present invention and the composition of the present invention results in a seal with unexpected resistance to extrusion and wear compared to hereinbefore utilized compositions.

Although there has been hereinabove-described a specific arrangement of a bearing seal material and a method of manufacture thereof in accordance with the present invention for the purposes of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the invention as defined in the appended claims.

TABLE I

ACCELERATED DESTRUCTIVE ROTARY TESTS USING PTFE BASED COMPOSITIONS

| Example No. | Bearing Composition | Percentage By Weight of Components | Percent By Volume of Components | Specific Gravity Grams/cm | Processing Method and Pressure |
|---|---|---|---|---|---|
| 1 | PTFE-Graphite | 90% PTFE<br>10% graphite | 87.75%<br>12.25% | 2.16 | free sintered |
| | Test Results | | Comments | | |
| | Failure due to massive extrusion and leakage of seal at (5) min. from start of test on external seal. | | Pump would not keep pressure. Oil and shaft showed a brown purple tempering color at approx. 520 deg. F. Heavy seal wear. | | |
| 2 | PTFE-PPS<br>Ryton V-1 | 90% PTFE<br>10% Ryton V1 | 81.6%<br>18.4% | 2.04 | free sintered |
| | Test Results | | Comments | | |
| | Failure due to massive extrusion and leakage of seal at (5) min. from start of test. External seal. | | Pump would not maintain pressure. Oil and shaft very hot at approx. 520 deg. F. Heavy seal wear. | | |
| 3 | PTFE<br>Ekonol | 85% PTFE<br>15% Ekonol | 79.63%<br>18.53% | 2.16 | free sintered |
| | Test Results | | Comments | | |
| | Failure due to extrusion and leakage of seal approx. (8) min. from start of test. External seal. | | Pump maintained pressure but leakage was steady. Oil and shaft very hot at approx. 550 deg. F. Heavy seal wear. | | |
| 4 | PTFE<br>Glass fiber | 85% PTFE<br>15% glass | 79.63%<br>20.37 | 2.11 | free sintering |
| | Test Results | | Comments | | |
| | Failure due to extrusion and leakage of seal after (7) min. from start of test. External seal. | | Pump maintained some pressure but leakage was steady. Shaft temperature approx. 570 deg. F. Moderate seal wear. | | |
| 5 | PTFE carbon fiber (VYB) | 93% PTFE<br>7% VYB | 89.64%<br>10.36% | 2.14 | free sintering |
| | Test Results | | Comments | | |
| | Failure caused by | | Pump operation inter- | | |

TABLE I-continued

ACCELERATED DESTRUCTIVE ROTARY TESTS USING PTFE BASED COMPOSITIONS

| Example No. | Bearing Composition | Percentage By Weight of Components | Percent By Volume of Components | Specific Gravity Grams/cm | Processing Method and Pressure |
|---|---|---|---|---|---|
| | steady leakage of seal and some extrusion after (35) min. from start of test. External seal. | | mittently. Oil very hot and shaft showed a tempering color dark blue at 600 deg. F. Little seal wear. | | |
| 6 | PTFE<br>Amorphous Carbon | 85% PTFE<br>15% Carbon | 78.34%<br>21.66% | 2.08 | free sintering |
| | Test Results | | Comments | | |
| | Failure due to heavy leakage of seal after (38) minutes from start of test. With extrusion of seal. External seal. | | Shaft very hot. Estimated at 600 deg. F. Heavy seal wear. | | |
| 7 | PTFE<br>Glass fiber<br>Molydisulfide | 85% PTFE<br>15% glass fiber<br>5% MoS2 | 76.3%<br>20.74%<br>2.96% | 2.15 | free sintering |
| | Test Results | | Comments | | |
| | Failure caused by extrusion and leakage after (5) min. of start of test. External seal. | | Pump operating intermittently to maintain pressure due to leakage through external seal. Shaft temperature approx. 550 deg. F. Heavy seal wear and extrusion. | | |
| 8 | Rulon A | Proprietary composition Dixon Corp. | Proprietary composition | 2.24 | free sintering |
| | Test Results | | Comments | | |
| | Failure due to heavy extrusion and leakage after (10) min. from start of tests. External seal. | | Pump would pump steadily to replenish oil leaking thru external seal. Shaft temperature approx. 550 deg. F. Heavy seal wear and extrusion. | | |
| 9 | PTFE<br>Carbon Fiber<br>Carbon black<br>MoS2<br>Natural graphite | 74% PTFE<br>15% Cbn Fibr<br>7% Cbn Blk<br>3% MoS2<br>1% N. Graph. | 66.71%<br>20.77%<br>9.49%<br>1.68% | 2.03 | hot compacted at 7500 psi |
| | Test Results | | Comments | | |
| | Failure after (21) min. due to cracking of the seals. Material excessive brittle. External Seal. | | Pump would not maintain pressure. Operating continuously due to failure of external seal. Moderate seal wear and extrusion | | |
| 10 | PTFE<br>Bronze<br>MoS2 | 40% PTFE<br>55% Bronze<br>5% MoS2 | 62.71%<br>32.42%<br>4.86% | 3.54 | free sintered |
| | Test Results | | Comments | | |
| | Failure within (30) min. of test start due to massive leakage and extrusion. External seal. | | Pump operating continuously. Shaft temperature at approx. 500 deg. F. Moderate seal wear and extrusion. | | |
| 11 | Rulon LD | Proprietary composition Dixon Corp. | Proprietary | 2.27 | free sintering |
| | Test Results | | Comments | | |
| | Failure by steady leakage began (15) min. after start of test. At (40) min. extensive extrusion and leakage. External seal. | | Pump operating intermittently to supply oil to leaky seal. Shaft temperature at approx. 520 F. Heavy seal wear and extrusion. | | |
| 12 | PTFE<br>CP | 95% PTFE<br>5% CP | 92.23%<br>7.77% | 2.15 | free sintering |
| | Test Results | | Comments | | |
| | Failure caused due to steady leakage of seal after (40) min. from start of test with heavy seal extrusion. External | | Shaft hot (dark purple) at approx. 550 deg. F. Pump operating intermittently. Moderate seal wear. | | |

TABLE I-continued

ACCELERATED DESTRUCTIVE ROTARY TESTS USING PTFE BASED COMPOSITIONS

| Example No. | Bearing Composition | Percentage By Weight of Components | Percent By Volume of Components | Specific Gravity Grams/cm | Processing Method and Pressure |
|---|---|---|---|---|---|
| | seal. | | | | |
| 13 | PTFE | 90% PTFE | 87.37 | 2.14 | free |
| | CP | 10% CP | 12.63% | | sintering |
| | Test Results | | Comments | | |
| | Failure caused by steady leakage of seal. Moderate extrusion after (72) min. from start of test. External seal wear. | | Shaft hot, dark purple at approx. 550 deg. F. Pump operating intermittently. Moderate seal wear. | | |
| 14 | PTFE | 85% PTFE | 82.52% | 2.12 | free |
| | CP | 15% CP | 17.48% | | sintering |
| | Test Results | | Comments | | |
| | Failure caused by steady leakage with light extrusion after 90 minutes of start of tests. External seal. | | Shaft hot with tempering color dark blue, approx. 550 deg. F. Pump operating intermittently. Little seal wear. | | |
| 15 | PTFE | 73% PTFE | 66.29% | 2.05 | Hot |
| | Carbon fiber | 15% Cbn Fibr. | 20.92% | | Compacted |
| | CP | 10% CP | 10.90% | | at 7500 psi |
| | Polymist 5A* | 2% Polymist | 1.89% | | |
| | Test Results | | Comments | | |
| | Failure after (20) hours of test due to progressive seal wear. | | Failure probably caused by excessive amount of filler in PTFE composition which was caused by poor kneading of the PTFE resulting in rapid seal wear. Shaft was light blue in color 550 F. | | |
| 16 | PTFE | 83% PTFE | 78.49% | 2.11 | free |
| | Carbon fiber | 7% Cbn Fibr | 10.17% | | sintered |
| | CP | 10% CP | 11.35% | | |
| | Test Results | | Comments | | |
| | Failure caused by steady leakage after a test of (37) hours. External seal. | | Pump operating intermittently, light seal wear. Light extrusion. Shaft temperature at 550 F. approx. | | |
| 17 | PTFE | 83% | 78.49% | 2.13 | free |
| | Carbon fiber/ CP mixture | 12% | 15.21% | | sintered |
| | CP | 5% | 5.67% | | |
| | Test Results | | Comments | | |
| | Failure caused by steady leakage after test of (44) hours. Failure occurred at external seal. | | Pump operating intermittently. Light seal wear. Light extrusion of shaft. Temperature of shaft at approx. 550 F. | | |

PTFE = Polytetrafluoroethylene
CP = Copolymer of hexafluoroisobutylene and vinylidene fluoride
*Irradiated PTFE

What is claimed is:

1. A method for the manufacture of a bearing seal comprising:

coating a filler with a copolymer of hexafluoroisobutylene and vinylidene fluoride, said copolymer comprising about 10 to about 52 mol percent 3,3,3,-trifluoro-2-trifluoromethyl propene and correspondingly about 90 to about 48 percent 1,1-difluoroethylene;

heating the coated filler to bond the copolymer of hexafluoroisobutylene and vinylidene fluoride to the filler and thereafter cooling the coated filler;

pulverizing the coated cooled filler;

adding the pulverized filler coated with copolymer of hexafluoroisobutylene and vinylidene fluoride to polytetrafluoroethylene, said polytetrafluoroethylene having a particle size greater than about 25 microns;

mixing the combined filler coated with the copolymer of hexafluoroisobutylene and vinylidene fluoride and polytetrafluoroethylene into a uniform blend thereof; and, compacting and heating the blend into a preselected shape.

2. The method according to claim 1 further comprising the step of adding a particulate copolymer of hexafluoroisobutylene and vinylidene fluoride with the pulverized filler coated with copolymer of hexafluoroisobutylene and vinylidene to polytetrafluoroethylene.

3. The method according to claim 1 wherein the filler is coated with a solid copolymer of hexafluoroisobutylene and vinylidene fluoride having a particle size greater than about 10 microns.

4. The method according to claim 1 wherein the coated cooled fillers are pulverized to a particle size from between about 10 microns and about 150 microns.

5. The method according to claim 4 wherein the polytetrafluoroethylene has a particle size between about 25 microns and 90 microns.

6. The method according to claim 5 wherein the blend of filler coated with copolymer of hexafluoroisobutylene and vinylidene fluoride and polytetrafluoroethylene comprises about 0.1 to about 25 percent by weight copolymer of hexafluoroisobutylene and vinylidene fluoride, and about 0.1 to about 25 percent by weight filler.

7. The method according to claim 6 wherein the filler is selected from the group consisting essentially of carbon, metal, glass, carbide, mineral fibers, disulfide, sulfide, polymeric, polyester fluoride and ceramic fibers.

8. A method for the manufacture of a material suitable for seals comprising:

coating reinforcement fibers with a melt-processable copolymer of hexafluoroisobutylene and vinylidene fluoride, said copolymer comprising about 10 to about 52 mol percent 3,3,3,-trifluoro-2-trifluoromethyl propene and correspondingly about 90 to about 48 percent 1,1-difluoroethylene;

heating the coated fibers to bond the melt-processable copolymer of hexafluoroisobutylene to the fibers and thereafter cooling the coated fibers;

pulverizing the coated cooled fibers;

adding the pulverized fibers coated with copolymer of hexafluoroisobutylene and vinylidene fluoride to polytetrafluoroethylene, said polytetrafluoroethylene having a particle size greater than about 25 microns;

mixing the combined fibers coated with the copolymer of hexafluoroisobutylene and vinylidene fluoride and polytetrafluoroethylene into a uniform blend thereof; and, sintering the blend to form a solid.

9. The method according to claim 8 further comprising the step of adding a solid copolymer of hexafluoroisobutylene and vinylidene fluoride with the pulverized coated cooled filler to polytetrafluoroethylene.

10. The method according to claim 8 wherein the fibers are coated with a solid copolymer of hexafluoroisobutylene and vinylidene fluoride having a particle size greater than 10 microns.

11. The method according to claim 10 wherein the coated cooled fibers are pulverized to a particle size from between about 10 microns to about 150 microns.

12. The method according to claim 11 wherein the blend of fibers coated with copolymer of hexafluoroisobutylene and vinylidene fluoride and polytetrafluoroethylene comprising about 0.1 to about 25 percent by weight copolymer of hexafluoroisobutylene and vinylidene fluoride, and about 0.1 to about 25 percent by weight fibers.

13. The method according to claim 12 wherein the fibers are selected from the group consisting essentially of carbon, metal, glass, carbide, mineral fibers, disulfide, sulfide, polymeric and ceramic fibers.

14. The method according to claim 13 wherein the fibers comprise ceramic whiskers.

15. A non-melt-processable material suitable for bearing seals comprising:

a fiber coated with a copolymer of hexafluoroisobutylene and vinylidene fluoride, said coated fiber being dispersed in polytetrafluoroethylene, said copolymer of hexafluoroisobutylene comprising about 0.1 to about 25 percent by weight of the non-melt-processable material, said fiber comprising about 0.1 to about 25 percent by weight of the non-melt-processable material.

16. The non-melt-processable material according to claim 15 wherein the copolymer comprises about 10 to about 52 mol percent 3,3,3-trifluoro-2-trifluoromethyl propene and correspondingly about 90 to about 48 percent 1,1-difluoroethylene.

17. The non-melt-processable material according to claim 16 wherein the fiber comprises a fiber selected from the group consisting essentially of glass, carbon, graphite, carbide, mineral, polymeric and ceramic fibers, said fiber having a length of about 10 microns to about 150 microns.

18. A method for the manufacture of a composition comprising:

adding a copolymer of hexafluoroisobutylene and vinylidene fluoride in particulate form to polytetrafluoroethylene in particulate form, said copolymer having a particle size greater than about 50 microns, said polytetrafluoroethylene having a particle size greater than about 25 microns;

mixing the combined copolymer of hexafluoroisobutylene and vinylidene fluoride and polytetrafluoroethylene to form a uniform blend thereof with the copolymer comprising between about 0.1 percent to about 60 percent by weight of the blend; and sintering the blend into a preselected shape.

19. The method according to claim 18 wherein the copolymer comprises about 10 to about 52 mol percent 3,3,3-trifluoro-2-trifluoromethyl propene and correspondingly about 90 to about 48 percent 1,1-difluoroethylene.

20. The composition made in accordance with claim 18.

* * * * *